US010350660B2

(12) United States Patent
Suzuki et al.

(10) Patent No.: US 10,350,660 B2
(45) Date of Patent: Jul. 16, 2019

(54) MANUFACTURING METHOD FOR INTERLOCKED TUBE AND MANUFACTURING DEVICE THEREFOR

(71) Applicant: SHOWA RASENKAN SEISAKUSHO CO., LTD., Tokyo (JP)

(72) Inventors: Norifusa Suzuki, Tokyo (JP); Ryouichi Fukabori, Saitama (JP)

(73) Assignee: SHOWA RASENKAN SEISAKUSHO CO., LTD., Tokyo (JP)

( * ) Notice: Subject to any disclaimer, the term of this patent is extended or adjusted under 35 U.S.C. 154(b) by 674 days.

(21) Appl. No.: 14/909,872

(22) PCT Filed: Feb. 27, 2015

(86) PCT No.: PCT/JP2015/056758

§ 371 (c)(1),
(2) Date: Feb. 3, 2016

(87) PCT Pub. No.: WO2015/137261

PCT Pub. Date: Sep. 17, 2015

(65) Prior Publication Data

US 2016/0175904 A1 Jun. 23, 2016

(30) Foreign Application Priority Data

Mar. 13, 2014 (JP) ..... 2014-75769

(51) Int. Cl.

| | |
|---|---|
| ***B21C 37/12*** | (2006.01) |
| ***B21C 37/15*** | (2006.01) |
| ***B21C 43/02*** | (2006.01) |

(52) U.S. Cl.

CPC ..... *B21C 37/121* (2013.01); *B21C 37/12* (2013.01); *B21C 37/127* (2013.01); *B21C 37/157* (2013.01); *B21C 43/02* (2013.01)

(58) Field of Classification Search

CPC ..... B21C 37/12; B21C 37/124; B21C 37/121; B21C 37/126; B21C 37/10; B21C 37/104; B21C 37/127; B21C 37/157; B21C 37/128

See application file for complete search history.

(56) References Cited

U.S. PATENT DOCUMENTS 4,672,549 A 6/1987 Saxton
4,724,596 A * 2/1988 Pavlyak ..... B21C 37/121 138/135

(Continued)

FOREIGN PATENT DOCUMENTS

CN 102334277 A 1/2012
EP 2 962 777 A1 1/2016

(Continued)

OTHER PUBLICATIONS

WIPO Google Translation of WO9815367A1 (Year: 2018).*

(Continued)

*Primary Examiner* — Pradeep C Battula
(74) *Attorney, Agent, or Firm* — Ladas & Parry LLP

(57) ABSTRACT

An automatic formation device or an automatic formation system sets an equipment operation time from a required manufacturing time per product during the manufacturing of tubes having a round, polygonal, or oblong cross-section, wherein values are calculated from a product diameter (D), and a pitch (P), a product length (L) and a preset time (T) of a metal band plate to be wound, operations of respective components are controlled on the basis of the calculated values while the respective values are being controlled, and the metal band plate is held by a chuck that is disposed on the tip side of a winding core member and rotates in a synchronized manner so as to prevent loosening of the wound metal band plate by tightening/untightening the (Continued)

metal band plate as needed. Also, a rotation speed correction function for a motor system is added.

14 Claims, 9 Drawing Sheets

(56) References Cited

U.S. PATENT DOCUMENTS

| | | | |
|---|---|---|---|
| 2011/0277525 | A1 | 11/2011 | Curtis |
| 2012/0013281 | A1 | 1/2012 | Watanabe |
| 2015/0040372 | A1 | 2/2015 | Suzuki |

FOREIGN PATENT DOCUMENTS

| | | | | |
|---|---|---|---|---|
| JP | 56-126025 | A | 10/1981 | |
| JP | 61-209738 | | 9/1986 | |
| JP | 1-254384 | A | 10/1989 | |
| JP | 6-344025 | A | 12/1994 | |
| JP | 7-16658 | A | 7/1995 | |
| JP | 8-218862 | A | 8/1996 | |
| JP | 10-166046 | A | 6/1998 | |
| JP | 11-254384 | A | 9/1999 | |
| JP | 11-344168 | A | 12/1999 | |
| JP | 2000-312973 | A | 11/2000 | |
| JP | 2004-52810 | A | 2/2004 | |
| JP | 3686973 | B2 | 6/2005 | |
| JP | 2007-30025 | A | 2/2007 | |
| JP | 5488946 | B1 | 4/2014 | |
| WO | WO-9815367 | A1 * | 4/1998 | ..... B21C 37/121 |
| WO | 2010/082058 | A1 | 7/2010 | |
| WO | 2014/132455 | A1 | 9/2014 | |

OTHER PUBLICATIONS

Espacenet English abstract of JP 11-254384 A.
Chinese Office Action dated Oct. 9, 2017 for Chinese Application No. 201580000498.4 with English translation.
Supplementary European Search Report (SESR) dated Oct. 9, 2017 for EP Application No. 15761150.0.
Espacenet English abstract of CN 102334277 A.
Espacenet English abstract of JP 6-344025 A.
English translation of JP 6-344025 A.
Espacenet English abstract of JP 3686973 B2.
English translation of JP 3686973 B2.
English translation of JP 2007-30025 A.
International Search Report (ISR) dated May 19, 2015 for International Application No. PCT/JP2015/056758.
Espacenet English abstract of JP 11-344168 A.
Espacenet English abstract of JP 2004-52810 A.
Espacenet English abstract of JP 2007-30025 A.
Espacenet English abstract of JP 8-218862 A.
Espacenet English abstract of JP 10-166046 A.
Japanese Office Action (Notification for Rejection) for Japanese Application No. 2014-075769.
Japanese Office Action (Notification of Reasons for Refusal) for Japanese Application No. 2014-075769.
Taiwan Office Action dated Feb. 22, 2016 for Taiwan Application No. 10520179470.
Espacenet English abstract of JP 56-126025 A.
Espacenet English abstract of JP 7-16658 A.
Espacenet English abstract of JP 2000-312973 A.
Espacenet English abstract of JP 1-254384 A.
Espacenet English abstract of JP 5488946 B1.
Espacenet English abstract of EP 2 962 777 A1.

* cited by examiner

MANUFACTURING METHOD FOR INTERLOCKED TUBE AND MANUFACTURING DEVICE THEREFOR

CROSS-REFERENCE TO RELATED APPLICATION

The present application is the U.S. national phase of PCT Application No. PCT/JP2015/056758 filed on Feb. 27, 2015, which claims a priority of the Japanese patent application JP2014-75769 filed on Mar. 13, 2014, which is incorporated herein by reference in its entirety.

TECHNICAL FIELD

The present disclosure relates to a manufacturing method for an interlocked tube and a manufacturing device therefor, which is an automatic formation device or an automatic formation system that sets an equipment operation time from a required manufacturing time per product during the manufacturing of tubes having a round, polygonal, or oblong cross-section. The tube may be easily and precisely shaped and uneasily loosened, so as to provide excellent machining performance when the interlocked tube is cut off and provide excellent operation efficiency for the manufacturing device itself.

BACKGROUND

In the past, as an exhaust tube for a vehicle such as an automobile, a flexible tube as shown in FIG. 9, is well known. That is, the flexible tube 1 is a component capable of preventing the vibration from an engine side from being transferred to a downstream member, etc. Therefore, An interlocking-type flexible tube 2 (hereinafter referred to as "interlocked tube") for communicating an upstream member and the downstream member is arranged in the middle, and its outside is arranged with a bellows 3 having a bellows portion and further arranged with an outer blade 4. Both end portions 3*a* and 4*a* of the bellows 3 and the outer blade 4 are provided with a protector 5 bent in such a manner as to coincide with two ends 3*a*, 4*a* of the interlocked tube 2, respectively.

However, for the interlocked tube 2 of the flexible tube 1, as shown by the arrow in FIG. 9, a tabular metal band plate 2*a* is shaped into a curved metal band plate 2*b* (see FIG. 10) with a cross section being S-shaped or the like and wound helically so that bending portions at both sides thereof are engaged with each other. As a result, it is able to form the flexible interlocked tube which can be stretched in both axial and radial directions.

Moreover, when shaping the interlocked tube, the elongate tabular metal band plate 2*a* with a certain width is extracted from a decoiler 6 and then fed into a multistage roll-forming device 8 while coating with lubricating oil by an oil-applying device 7 as shown in FIG. 10, and inserted between an upper roller 8*a* and a lower roller 8*b* of the multistage roll-forming device 8, so as to form tabular metal band plate 2*a* into the curved metal band plate 2*b* with an S-shaped cross section (as shown by an extended line in FIG. 9). This curved metal band plate 2*b* is fed into a roll winding device 9 and helically wound in a way that both sides thereof are engaged with each other. It is cut into a predetermined length by a plasma cutting device (not shown).

In addition, there are cases that such interlocked tube has a cross section with a circular shape or a polygonal shape, For example, Patent Literature 1 discloses that, for an interlocked tube with a circular cross section, although with excellent impermeability, it has the defect of being easy to loosen during rotating, i.e., it has defects of being loosened in winding and easy to be detached. Further, it is described that, for an interlocked tube with a polygonal cross section, although with poor impermeability, it is able to accurately set the rigidity of the interlocked tube and the detachability of a guiding portion connected thereto due to the vibration. The polygonal end has the function to enable the hose to rotate without loosening while maintaining its predetermined shape and winding state, etc (see paragraphs [0002]-[0005] of the Patent Literature 1).

That is, for the interlocked tube with a polygonal cross section, although a core member with a polygonal cross section is used during winding, it can be hung over a polygonal end of the core member. For example, Patent Literature 2 (see FIG. 2) and Patent Literature 4 (see FIG. 12) show such an interlocked tube with a polygonal cross section.

On the other hand, for the interlocked tube with a circular cross section, although a core member with a circular cross section is used during winding, it cannot be hung over due to its circular shape, and springback will occur during the winding. The tube cannot be wound while maintaining its predetermined shape, and rotation and loose may occur due to the relationship between springback and the thrust. In addition, the interlocked tube with an oblong cross section also has the same problem.

In order to overcome the above-mentioned drawbacks, Patent Literature 4 discloses in FIG. 1 that, after the interlocked tube is wound into a diameter less than that of the final shape, a rewinding force, and further, a force in a direction opposite to a rotation direction, is applied to the interlocked tube. Moreover, the mechanism for applying to the interlocked tube the force in a direction opposite to the rotation direction is a roller or an elastic member.

On the other hand, the applicant of the disclosure has ever obtained patents relating to a method and a device for manufacturing an interlocking-type flexible tube. The present disclosure is a resultant by researching the manner for forming the interlocking-type flexible tube so that a core member side on which the metal bank plate is wound is in a fixed state and configured to be taken as a workpiece side, rather than the past manner in which one side of the metal band plate on which the metal band plate is fed into the decoiler is taken as the workpiece side. Based on this, an interlocking type flexible tube with a diameter of continuously high efficiency and high precision is provided (see paragraph 0009, etc of the same patent literature).

EXISTING TECHNOLOGY LITERATURES

Patent Literatures

Patent Literature 1: Japanese laid-open 11-344168;
Patent Literature 2: Japanese laid-open 2004-52810;
Patent Literature 3: Japanese laid-open 2007-30025;
Patent Literature 4: Japanese laid-open 08-218862; and
Patent Literature 5: Japanese patent 3686973.

SUMMARY

Problems to be Solved

The inventor considered the background and studied to provide an interlocked-type flexible tube with diameter dimension of continuously high efficiency and high precision based on the structure of a core member side as a workpiece side, i.e., to find an automatic controlling device, which can prevent springback even if the interlocked tube is shaped with a round, polygonal or oblong cross section, which can easily and precisely shape the interlocked tube in a non-loose manner without any rotation, and which can provide excellent operation efficiency.

In addition, there are other requirements for easily and efficiently shaping the interlocked tube. For example, the additional oil-applying device is not required to be arranged at a preceding stage of multistage roll-forming device, instead an upper portion of the multistage roll-forming device has an oil-applying function integrally so as to apply the oil efficiently. It is also required to improve an oiling agent, e.g., lubricating oil mixed with water may be used, so as to improve the operation efficiency and reduce the cost. In addition, for interlocked tube cutting device cooperating with the main body of the apparatus, it is required to form granular atomized slags during the cutting, and to remove these slags accumulated during the cutting efficiently.

An object of the present disclosure is to provide a manufacturing method for an interlocked tube and a manufacturing device therefor, which is an automatic formation device or an automatic formation system that sets an equipment operation time from a required manufacturing time per product during the manufacturing of tubes having a round, polygonal, or oblong cross-section. The tube may be easily and precisely shaped in a non-loose manner, so as to provide excellent machining performance when the interlocked tube is cut off and provide excellent operation efficiency for the manufacturing device itself.

Method to Solve Problems

In order to achieve the above object, as a method for manufacturing an interlocked tube, as described in solution 1, the interlocked tube is an interlocked tube with a round, polygonal or oblong cross-section, and shaped by bending a elongate metal band plate with a certain width into an S-shaped cross section and helically winding onto the metal band plate a winding core member in a way that two adjacent end portions thereof are engaged with each other by means of members for treating the metal band plate successively in accordance with instructions from a main computing-controlling member. The method for manufacturing the interlocked tube employs the following means: the main computing-controlling member configured to control actions of each member based on values calculated in accordance with product diameter (D), pitch (P), product length (L) and setting time (T) of the wound metal band plate, and to aggregate the values; a motor controlling member configured to perform treatment in accordance with instructions from the main computing-controlling member, and to perform three-axis synchronous control on a forming members system spindle motor III, a material conveying system roller motor II and a clamping device system cover motor V with the forming members system spindle motor III as a reference axis via a pulse instruction from the main computing-controlling member; and a clamping device configured to synchronously rotate in such a manner that the wound metal band cannot be loosened, and to clamp the metal band plate in a freely loosen or freely tighten manner. Further, the method for manufacturing an interlocked tube according to solution 2 is that the motor controlling member has a cutting member system pinch roller motor IV synchronously controlled based on the three-axis synchronous control. Further, the method for manufacturing an interlocked tube according to solution 3 is that the main computing-controlling member adds a desired correction value to a rotation speed of a motor system. Further, the method for manufacturing an interlocked tube according to solution 4 is that a pretreatment device cooperating with the main computing-controlling member comprises: a multistage roll-forming device configured to shape the tabular metal band plate extracted from a decoiler into a metal band plate with curved side portions; and an oil-applying device configured to apply an oily coating agent from an upper portion of the multistage roll-forming device, the oily coating agent being a lubricating oil mixed with water. Further, the method for manufacturing an interlocked tube according to solution 5 is that a cutting device cooperating with the main computing-controlling member is configured to receive instruction for absorbing slags and scraping out the accumulated slags. Further, the method for manufacturing an interlocked tube according to solution 6 is that the cutting device cooperating with the main computing-controlling member is configured to receive instruction of ejecting the air for cutting. Further, the method for manufacturing an interlocked tube according to solution 7 is that that the cutting device cooperating with the main computing-controlling member is configured to receive instructions for starting the cutting as in contact with the wound metal band plate, then departing from the wound metal band plate immediately so as to maintain a predetermined distance from the metal band plate, and then stopping the cutting.

As an apparatus for manufacturing an interlocked tube, as described in solution 8, the interlocked tube is an interlocked tube with a round, polygonal or oblong cross-section, and shaped by bending a elongate metal band plate with a certain width into an S-shaped cross section and helically winding the metal band plate onto a winding core member in a way that two adjacent end portions thereof are engaged with each other by means of devices for treating the metal band plate successively in accordance with instructions from a controlling device. The apparatus for manufacturing the interlocked tube comprises: the controlling device configured to control actions of each device based on values calculated in accordance with product diameter (D), pitch (P), product length (L) and setting time (T) of the wound metal band plate, and to aggregate the values; a motor system configured to perform treatment in accordance with instructions from the controlling device, and to perform three-axis synchronous control on a forming members system spindle motor III, a material conveying system roller motor II and a clamping device system cover motor V with the forming members system spindle motor III as a reference axis via a pulse instruction from the main computing-controlling member; and a clamping device configured to synchronously rotate in such a manner that the wound metal band cannot be loosened, and to clamp the metal band plate in a freely loosen or freely tighten manner. Further, the apparatus for manufacturing an interlocked tube according to solution 9 is that the motor system has a cutting member system pinch roller motor IV synchronously controlled based on the three-axis synchronous control. Further, the apparatus for manufacturing an interlocked tube according to solution 10 is that the controlling device adds a desired correction value to a rotation speed of the motor system. Further, the apparatus for manufacturing an interlocked tube according to solution 11 is that a pretreatment device cooperating with the controlling device is provided with: a multistage roll-forming device configured to shape the tabular metal band plate extracted from a decoiler into a metal band plate with curved side portions; and an oil-applying device configured to apply an oily coating agent from an upper portion of the multistage roll-forming device, the oily coating agent being a lubricating oil mixed with water. Further, the apparatus for manufacturing an interlocked tube according to solution 12 is that a cutting device cooperating with the controlling device is configured to receive instruction for absorbing slags and scraping out the accumulated slags. Further, the apparatus for manufacturing an interlocked tube according to solution 13 is that the cutting device cooperating with the controlling device is configured to receive instruction of ejecting the air for cutting.

Further, the apparatus for manufacturing an interlocked tube according to solution 14 is that the cutting device cooperating with the controlling device is configured to receive instructions for starting the cutting as in contact with the wound metal band plate, then departing from the wound metal band plate immediately so as to maintain a predetermined distance from the metal band plate, and then stopping the cutting.

Technical Effects

According to the disclosure of solutions 1 and 8, the interlocked tube is an interlocked tube with a round, polygonal or oblong cross-section, and formed by bending the elongate metal band plate with a certain width into an S-shaped cross section and helically winding onto a winding core member in a way that two adjacent end portions thereof are engaged with each other. During the manufacturing of the interlocked tube, the motor controlling member performs three-axis synchronous control on a forming members system spindle motor III, a material conveying system roller motor II and a clamping device system cover motor V with the forming members system spindle motor III as a reference axis according to a pulse instruction from the main computing-controlling member while calculating in accordance with product diameter, pitch, product length and setting time, and the metal band plate is held by a clamping device that is disposed on the tip side of a winding core member and rotates in a synchronized manner so as to prevent loosening of the wound metal band plate, so it is able to easily and precisely shaping in an efficient manner.

According to the disclosure of solutions 2 and 9, the motor controlling member enables the cutting member system pinch roller motor IV to be synchronously controlled based in the three-axis synchronous control of solution 1 or 8, so it is able to further easily and precisely shaping in an efficient manner.

According to the disclosure of solutions 3 and 10, due to the rotation speed correction function, it is able to reduce the material of the tube or the sliding of shaping the tube or the affect of mechanical consumption, i.e., mechanical loss, etc, and it is able to adjust the rotation speed to become normal.

According to the disclosure of solutions 4 and 11, the oil-applying device is not required to be arranged at a preceding stage of multistage roll-forming device, instead an upper portion of the multistage roll-forming device has an oil-applying function, and the lubricating oil mixed with water is used as the coating agent, so it is able to improve the operation efficiency and reduce the cost.

According to the disclosure of solutions 5 and 12, the cutting device may be used to absorb the slags and scrape out the accumulated slags, so it is able to remove the slags completely.

According to the disclosure of solutions 6 and 13, the air for cutting, rather than the expensive inert gases (e.g., Ar) or CO2 used in the past, is supplied during the cutting, so it is able to reduce the cost.

According to the disclosure of solutions 7 and 14, the cutting device starts the cutting when it is in contact with the wound metal band plate, and then is separated therefrom immediately so as to maintain a predetermined distance from the metal band plate. As a result, it is able to maintain the best cutting condition and prevent from cutting incompletely.

DETAILED DESCRIPTION

Figure 1:
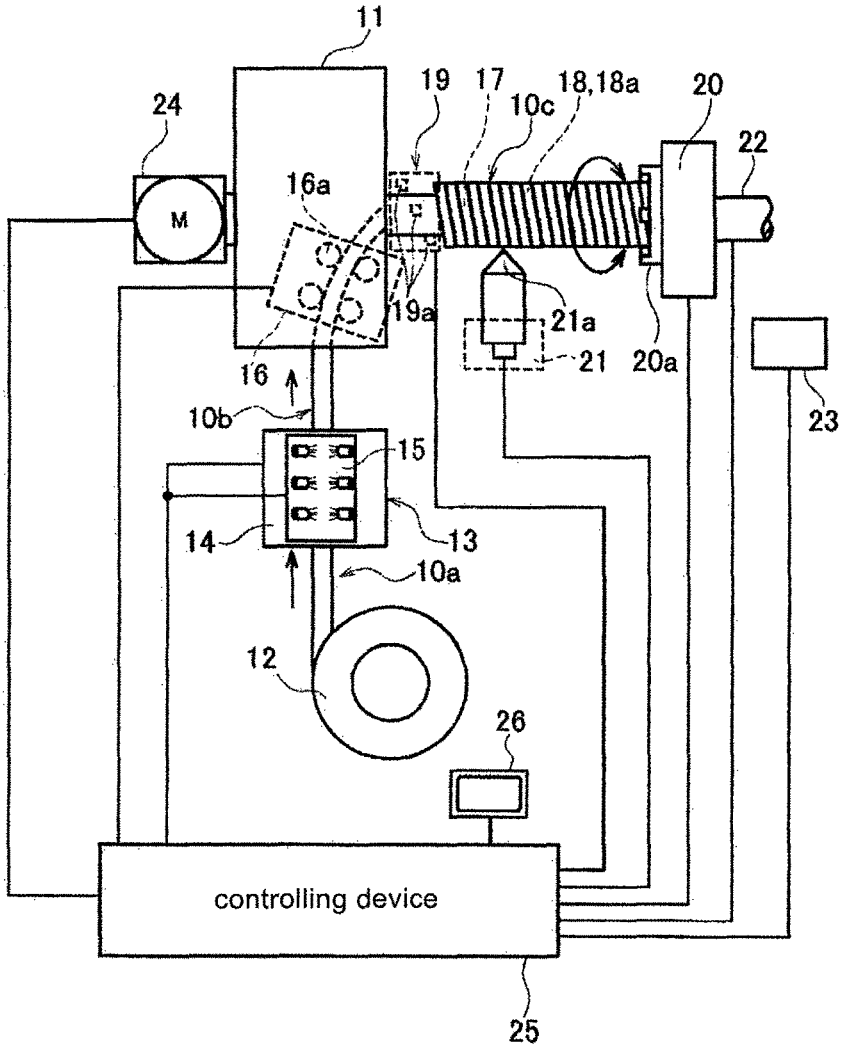
FIG. 1 is a top view showing a general construction of the present invention.
Figure 8:
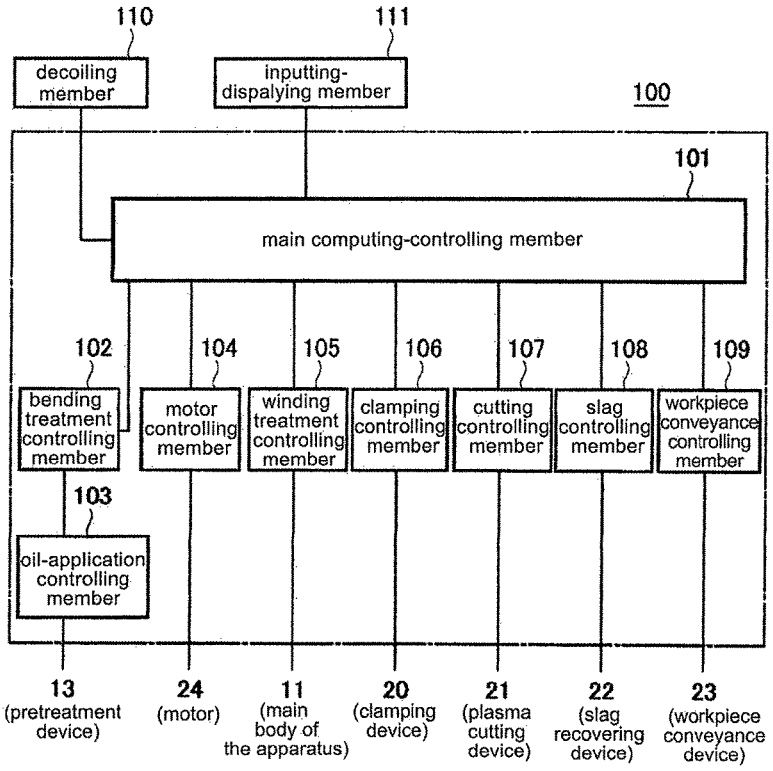
FIG. 8 is a view showing an electrical system of the present invention.
Figure 9:
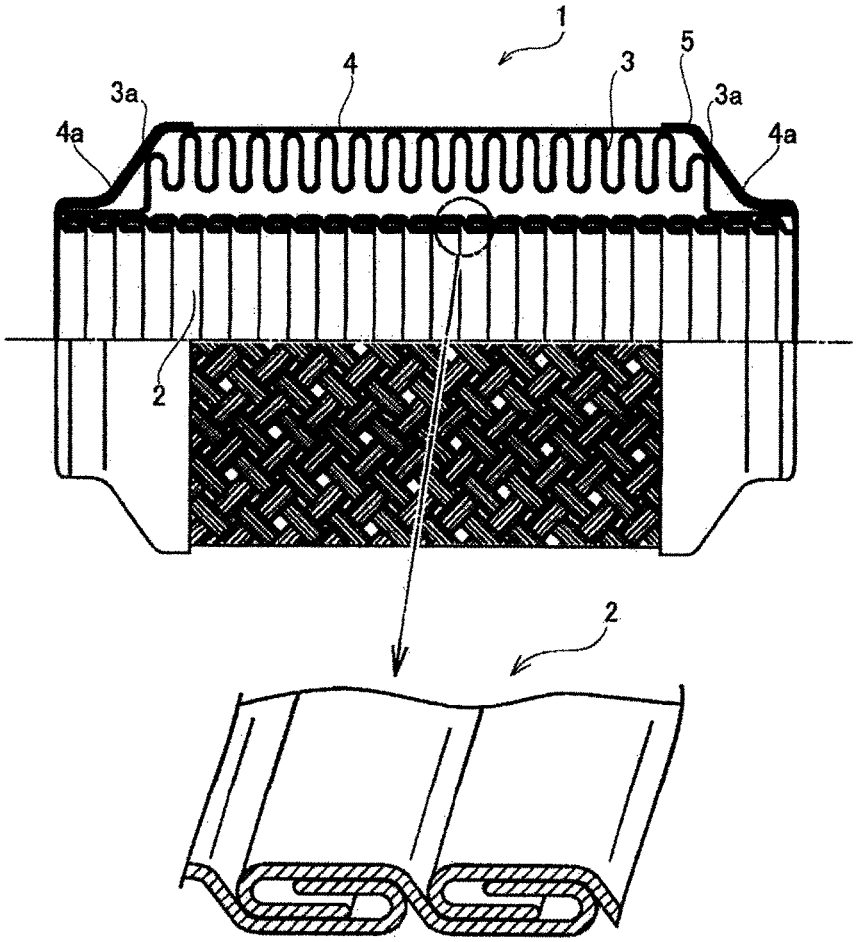
FIG. 9 are a half-sectional view and a partially enlarged sectional view showing an existing flexible tube.

The embodiments of the present disclosure will be described hereinafter in conjunction with the drawings. FIG. 1 is a top view showing a general construction of the present invention. The action of respective devices is, as shown in the figure, performed based on a control device 25 that aggregates the actions of the devices and performs the calculation. Similarly, the action of a system is, as shown in FIG. 8, performed based on a main computing-controlling member 101 of a system body 100. For either of the actions, the equipment operation time is set in accordance with a required manufacturing time per product. Therefore, the calculation is performed in accordance with the product diameter [mm], pitch [mm], product length [mm], and setting time (setting tact, i.e., target machining time per product).

That is, a half-finished interlocked tube 10 used as an exhaust tube for a vehicle or the like is obtained. An elongated, tabular metal band plate 10*a* with a certain width is bent into a curved metal band plate 10*b*, with a round, polygonal or oblong cross section, and then shaped into a curved metal band plate 10*c* which is wound helically. Then, the metal band plate 10*c* is cut into a predetermined length so as to obtain the half-finished interlocked tube 10 (also referred to as tube) formed of the following devices.

Figure 2:
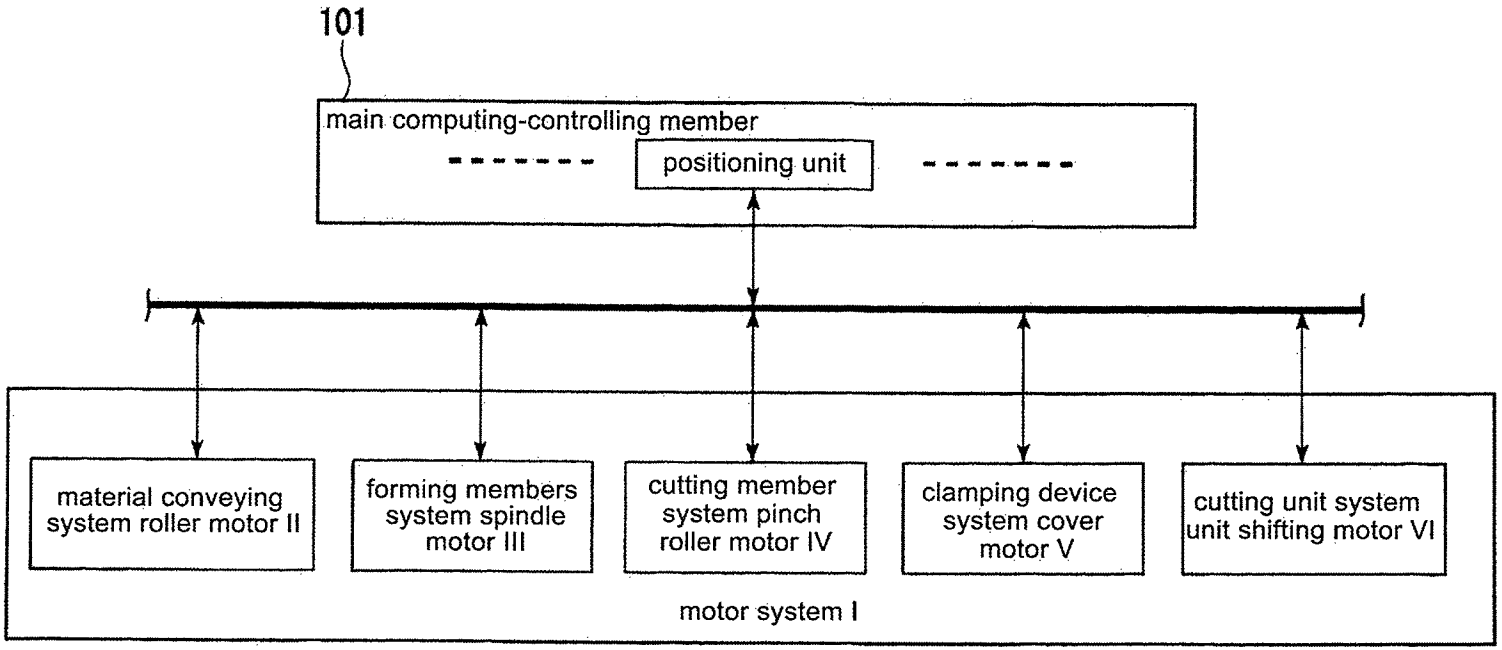
FIG. 2 is a view showing a motor system of the present invention.

Therefore, during treatment, as shown in FIG. 2, based on the aggregation of a positioning unit of the control device 25 (the main computing-controlling member 101), a motor system I that driving respective devices and moving a metal band plate 10 as a tube is formed of a material conveying system roller motor II for controlling the conveyance of the metal band plate, a forming members system spindle motor III for controlling a winding core member 17 for winding the metal band plate 10 as a tube, a cutting member system pinch roller motor IV located below a cutting core member 18, a clamping device system cover motor V for controlling a clamping device 20, and a cutting unit system unit shifting motor VI moving with the cutting member system pinch roller motor IV and the clamping device system cover motor V synchronously.

Therefore, three-axis synchronous control of the material conveying system roller motor II for controlling the conveyance of the metal band plate, the forming members system spindle motor III for controlling the winding core member 17 for winding the metal band plate 10 as a tube, and the clamping device system cover motor V for controlling the clamping device 20 is performed by using a pulse instruction from the positioning unit, with the forming members system spindle motor III for controlling the winding core member 17 as a reference axis. Further, based on the above, the cutting member system pinch roller motor IV located below the cutting core member 18 is also controlled simultaneously. That is, according to this function, operation status of accelerating or decelerating the motor system I may control operation synchronously. Further, the above-mentioned treatments are not limited here, and may have various designs and variation according to the idea of the invention.

Moreover, the motor system I has a rotation speed correction function because, even if all shafts rotate in the same speed, conveyance may not be steady due to factors such as the material of the metal band plate 10 as a tube, and the sliding of shaping the tube or mechanical consumption, i.e., mechanical losses. As a result, for shafts except the reference shaft of the forming member system spindle motor III for controlling the winding core member 17, an additional rotation speed correction function is added for adjustment so as to enable the rotation speed to become normal. That is, a theoretical value for the rotation speed of the motor system I is calculated according to the shape data of a product, and the speed is corrected by "%" relative to the theoretical value. For example, when the rotation speed of the material conveying system roller motor II for controlling the conveyance of the metal band plate 10 as a tube is desired to drop by 30% as compared with that of the forming members system spindle motor III for controlling the winding core member 17 as a reference axis, the rotation speed of the roller motor is set to 70% (100%→70%), etc.

That is, the positioning unit of the main computing-controlling member performs calculation and issues a pulse instruction (start-stop) according to input product parameters (product diameter, pitch, product length, manufacturing tact), so that the material conveying system roller motor II can input a value calculated by the positioning unit plus a single correction value. Further, the forming member system spindle motor II performs action without correcting the value calculated by the positioning unit. Further, the clamping device system cover motor V can input the value calculated by the positioning unit plus the single correction value. Further, the cutting member system pinch roller motor IV can input the value calculated by the positioning unit plus the single value. Further, the cutting unit system unit motor VI can input the value calculated by the positioning unit plus the single correction value.

Further, an example is illustrated for reference as preliminary calculation.

Length [mm] of material necessary for one product=Product diameter [mm]×π×(product length [mm]÷pitch [mm])

Material conveying speed(theoretical value [mm/min](linear velocity))=Material length [mm] ÷setting time [second]×60 [seconds]

Speed setting value [mm/min] of roller motor=Material conveying speed [mm/min]× roller rotation correction [%]

Speed setting value of spindle [rev/min]=Product length [mm] pitch [mm]÷setting time [second]× 60 [seconds]

There is no correction for basic axis
Speed of JOG sets operating by m/min

Speed setting value [rev/min] of cover motor as clamping device 20=Product length [mm]÷pitch [mm]÷setting time [second]×60 [second] >clamping device rotation correction [%]

Speed setting value [mm/min] of pinch roller=material conveying speed [mm/min]× pinch roller rotation correction [%]

*Speed setting value [mm/min] of unit shifting=Advance speed [mm/min] of product× unit shifting correction [%]=Product length [mm]÷setting time [second]×60 [seconds]×unit shifting correction [%]

Figure 10:
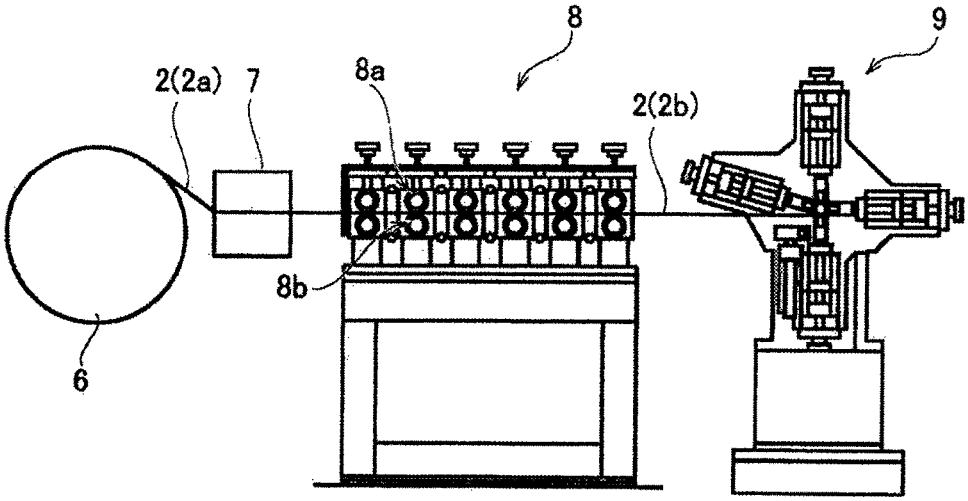
FIG. 10 is a schematic view showing the manufacturing of an existing interlocked tube.

Herein, configuration and actions of the devices are described in conjunction with FIG. 1. To begin with, a tabular metal band plate 10*a* disposed at a decoiler 12 is extracted from the decoiler 12, and then fed into a pretreatment device 13 including a multistage roll-forming device 14 and an oil-applying device 15. As shown in FIG. 10, the multistage roll-forming device 14 in the pretreatment device 13 is the well-known multistage roll-forming device substantially identical to the device in the past. The tabular metal band plate 10*a* is inserted into the respective stage of the multistage roll-forming device while forming the curved metal band plate 10*b* with an S-shaped cross section.

In addition, an upper portion of the multistage roll-forming device 14 in the pretreatment device 13 is integrally provided with the oil-applying device 15 for applying an oily coating agent, which is a lubricating oil mixed with water, onto a back surface of the successively formed curved metal band plate 10*b*.

Figure 3:
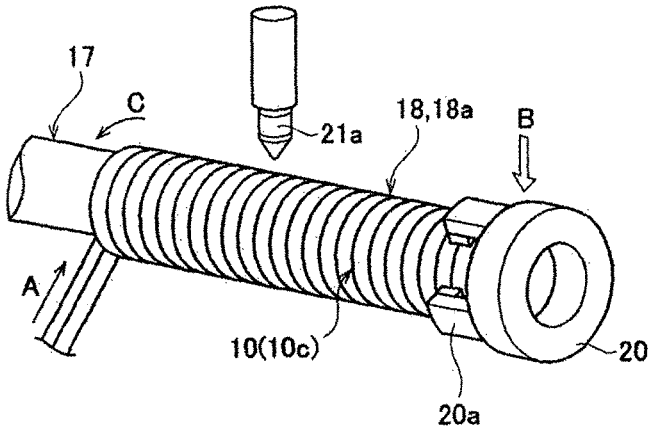
FIG. 3 is a perspective view showing the winding of the present invention.

A main body 11 of the apparatus helically winds the curved metal band plate 10*b* extracted from the pretreatment device 3 onto a winding core member 17 (see left side in FIG. 3). That is, the feeding direction of the curved metal band plate 10*b* extracted from the pretreatment device 13 is changed by direction-variable guiding device 16 having variable guiding rollers 16*a* . . . so as to helically wind the curved metal band plate 10*b* onto the winding core member 17.

In addition, a guiding device 19 is provided at the bottom of the winding core member 17. The guiding device 19 has winding guiding rollers 19*a* . . . provided on an axial line thereof, so that the curved metal band plate 10*b* in engagement with each other slides at a peripheral of the winding core member 17, so as to be wound helically. In FIG. 3, direction A is a winding-in direction.

Figure 6:
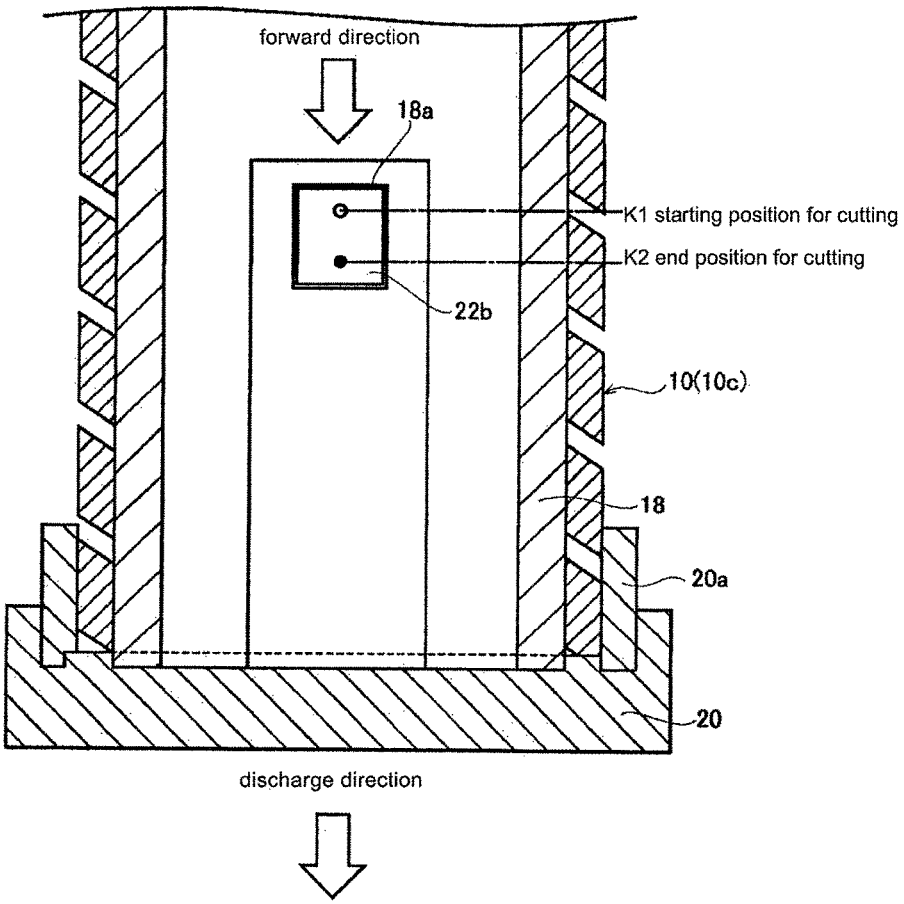
FIG. 6 is a top view showing the cutting portion in FIG. 4.
Figure 7:
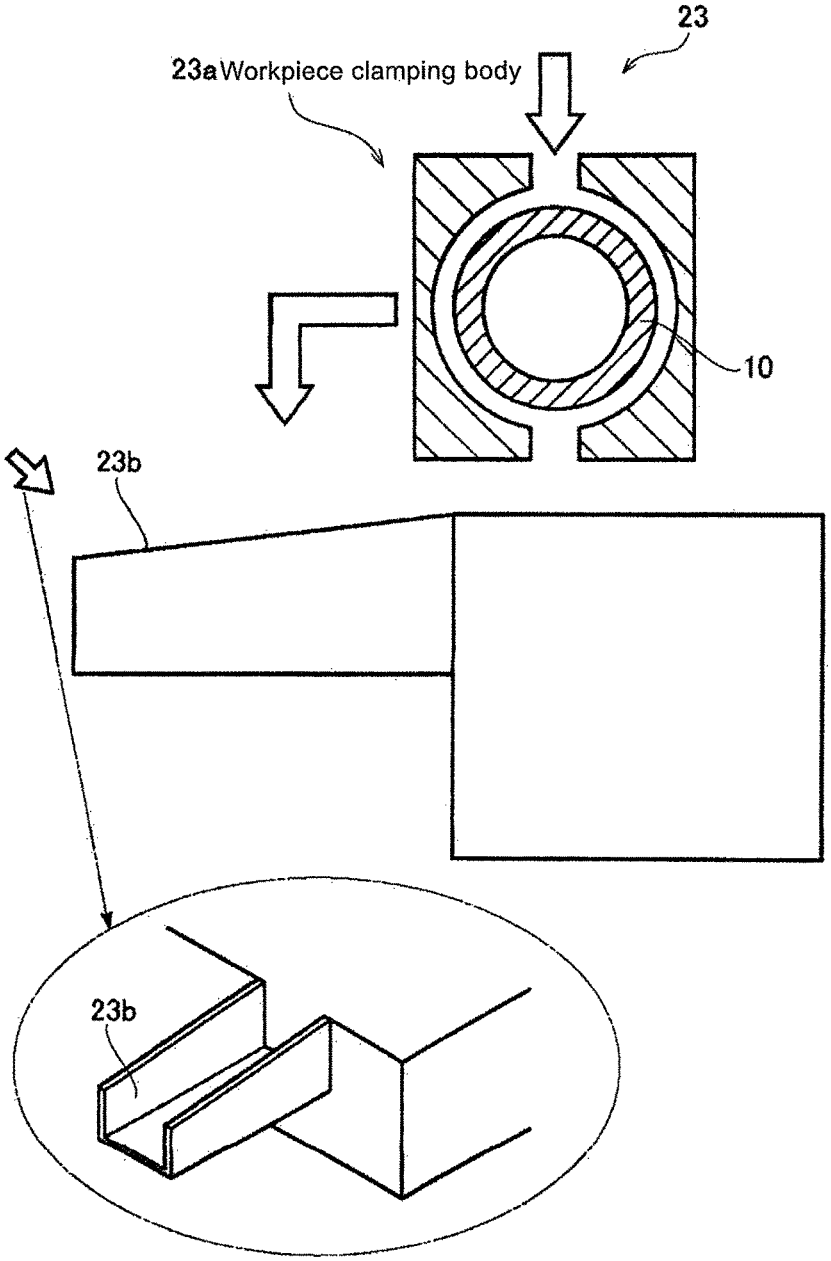
FIG. 7 is a view showing a workpiece conveyance device.

The winding core member 17 is driven to rotate by means of a motor 24 connected to the main body 11 of the apparatus, so as to wind the curved metal band plate 10*b* in a way that the end portions thereof are engaged with each other. In addition, a cutting core member 18 is provided in front of the winding core member 17, and an opening 18*a* (as shown in FIG. 6) for recovering slags is through provided at a predetermined position of the cutting core member 18, i.e., a position opposite to a cutting member 21*a* at a front end of a plasma cutting device 21, which will be described hereinafter.

Moreover, clamping device 20 for clamping the helical, metal band plate 10*b* wounded on the winding core member 17 (direction B in FIG. 3) is provided in front of the winding core member 17. As a result, it is able to prevent the springback or looseness which is caused by the rotation of the helical, metal band plate 10*b* toward an opposite direction (direction C in FIG. 3), while the clamping device is freely assembled in a detachable and switchable manner. In addition, the structure of the clamping device 20 is not particularly defined herein, as long as it can function as mentioned above.

The movable plasma cutting device 21 is provided at an upper portion of the cutting core member 18. The plasma cutting device 21, although being movably arranged at the upper portion of the cutting core member 18 in a unit shifting manner as mentioned above (not shown), is provided with a cutting member 21*a* at its front end for producing a plasma arc. The air for cutting is ejected from a cutting nozzle at a front opening of the cutting member 21*a* so as to heat and melt the helical, metal band plate 10*b* made of stainless steel, thereby to cut it of instantaneously.

Figure 4:
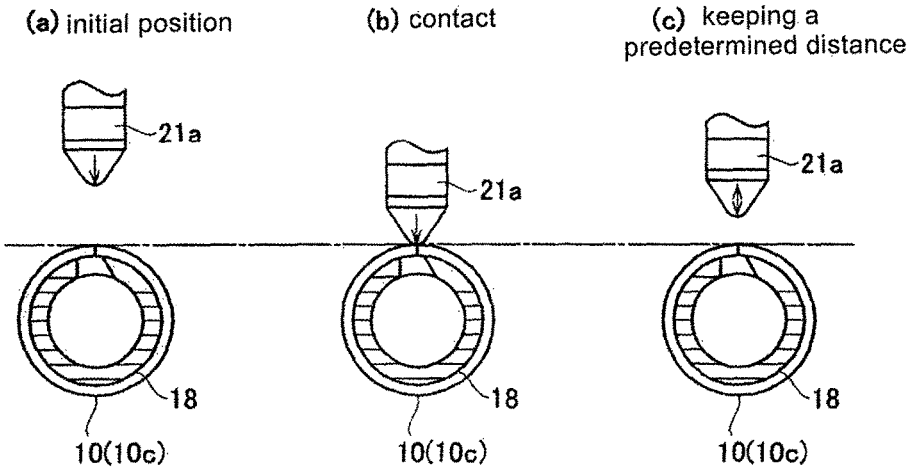
FIG. 4 is a view showing the actions during the cutting of the present invention.

For the discharge action of the cutting member 21*a*, as shown in FIG. 4, when the cutting member 21*a* is in a standby state, it is located above the cutting core member 18 (see FIG. 4(*a*)). If the cutting member 21 a is in action, it moves downward so that the cutting nozzle is in contact with the helical, metal band plate 10*c* instantaneously and discharges (see FIG. 4(*b*)). After that, the cutting member moves upward to a predetermined position, and cuts the metal band plate 10*c* as it discharges (see FIG. 4(*c*)). Finally, the discharge is stopped and the cutting member 21*a* returns to the initial position (see FIG. 4(*a*)).

In this situation, the cutting member 21*a* discharges while an electrode is in contact with the helical metal band plate (workpiece), after that, the cutting is performed while maintaining an appropriate distance between the electrode and the helical metal band plate (workpiece), and then the current is switched off so as to stop the cutting, as a result, it is able to prevent from cutting incompletely, or to prevent an excessively-melted cut portion and a deformation as the discharge is not stopped after the cutting.

In addition, various heat sources may be applicable, and in this embodiment, it is appropriate to employ the cutting used air with a high-temperature plasma arc to heat and melt and then cut off instantaneously. As a result, it is unnecessary to use the expensive inert gases e.g., Ar) or CO2, as those used in the prior art, and the cost will be reduced.

Figure 5:
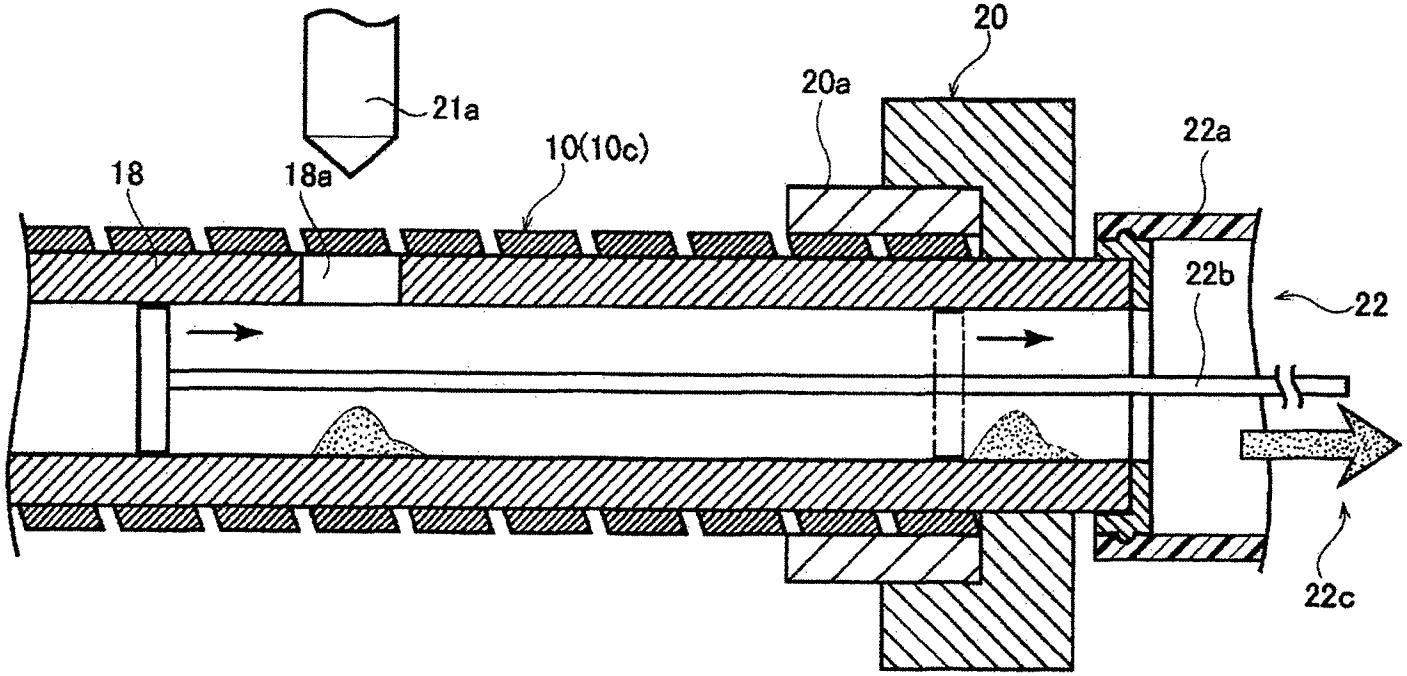
FIG. 5 is a sectional view showing the winding and cutting of the present invention.

FIGS. 5 and 6 show an enlarged portion of a cutting position. In FIG. 5, the cutting core member 18 and the clamping device 20 are provided at the cutting position in the forward direction of the helically wound curved metal band plate 10*c*. Meanwhile, slag recovering device 22 is provided inside the metal band plate 10*e*, the cutting core member 18 and the clamping device 20, and it is designed as a structure into which a tube 22*a* and a scraping device 22*b* may be inserted. In addition, the opening 18*a* of the cutting core member 18 is a slag receiving port, which is provided at a position opposite to the cutting member 21*a* of the plasma cutting device 21.

In FIG. 6, K1 represents an imaginary point of a starting position for cutting, K2 represents an imaginary point of an end position for cutting, and a distance therebetween represents a pitch for one revolution. However, when the metal band plate 10*c* moves for one pitch while rotating, the cutting member 21*a* will synchronously move with the metal band plate 10*c* for one pitch while rotating. In this way, it is cut along a line interlocked between the imaginary point K1 of the starting position for cutting and the imaginary point K2 of the end position for cutting.

As mentioned above, the slag recovering device 22 includes the tube 22*a*, the scraping device 22*b* and a discharge path 22*c*. The opening 18*a* of the cutting core member 18 for extracting the slags produced during cutting is provided at a position of the cutting core member 18 opposite to the cutting portion 21*a* to serve as the slag receiving port for receiving the slags produced during the cutting. The tube 22*a* is used to remove the slags absorbed from the opening 18*a* to the outside, the scraping device 22*b* is used to scrape the slags, and the discharge path 22*c* is used to remove the scraped slags.

In addition, a movement pitch for one rotation amount of the winding core member 17 and the cutting core member 18 (which, however, does not rotate itself), e.g., a distance between the starting position a for cutting and the end position b for cutting or a cutting time, is calculated as product diameter×pitch×product length×setting time. The term "setting time" represents a production time (a setting tact) for each product. By setting and executing the setting tact, it is able to ensure the planned, stable production.

A workpiece conveyance device 23 is provided at a final stage of the main body 11 of the apparatus, and it can move toward a Y-axis (up and down) and an X-axis (right and left). A workpiece clamping body 23*a* is provided at a front end of the workpiece conveyance device 23, so as to clamp the half-finished interlocked tube 10 which is cut into a predetermined size and convey it to a recovering case 23*b* at a conveyance region. In addition, the structure of the workpiece conveyance device 23 or the workpiece clamping body 23*a* is not particularly defined, as long as it can function as mentioned above.

The structure of an electrical system according to the present disclosure will be described hereinafter in conjunction with FIG. 8. The electrical system 100 is a system of instructions from a main computing-controlling member 101 (reference number 25 in FIG. 1) that performs the calculation and control in accordance with the actions of the members, which includes: a bending treatment controlling member 102 (13 in FIG. 1) that outputs the instruction signal to bend the tabular metal band plate 10*a* into the curved metal band plate 10*b*; an oil-application controlling member 103 (14 in FIG. 1); a motor controlling member 104 (24 in FIG. 1); a winding treatment controlling member 105 (11 in FIG. 1) that controls the winding core member 17 to obtain the helically wound curved metal band plate 10*c*; a clamp controlling member 106 (20 in FIG. 1); a cutting controlling member 107 (21 in FIG. 1); a slag controlling member 108 (22 in FIG. 1); a workpiece conveyance controlling member 109 (23 in FIG. 1); a decoding member 110 (12 in FIG. 1), and an inputting-displaying member 111, etc.

As mentioned above, the main computing-controlling member 101 performs the calculation and control for the actions of the members connected to the apparatus. The action calculation is performed in accordance with the product diameter, pitch, product length, setting time (setting tact), and the position status of the action of the members.

Based on input information from the decoiling member 110 when the actions are performed or the actions performed by the members in the apparatus, the bending treatment controlling member 102 sends instruction in accordance with the instructions from the main computing-controlling member 101, so that the tabular metal band plate 10*a* extracted from the decoiler 12 is bent in the pretreatment device 13 into the curved metal band plate 10*b*.

The oil-application controlling member 103 receives the instruction when an action signal is input along with the operation of the bending treatment controlling member 102, so that the coating agent, e.g., the lubricating oil mixed with water, is applied onto a back surface of the curved metal band plate 10*b* in the multistage roll-forming device 14.

When the curved metal band plate 10*b* is extracted from the pretreatment device 13 and fed into the main body 11 of the apparatus, instructions are input from the main computing-controlling member 101 to the motor controlling member 104, so as to operate the winding core member 17.

By sending instruction signal to the motor controlling member 104, the winding core member 17 starts to rotate, thereby to form the helically wound curved metal band plate 10*c*. In case the curved metal band plate 10*b* fed by the multistage roll-forming device 14 is superposed on the curved metal band plate 10*c* that has been wound into a helical form, the winding guiding roller 19*a* will be damaged. In order to avoid this situation, a load on the winding guiding roller 19*a* will be measured, and when the measured value is greater than a predetermined value, the winding treatment controlling member 105 will send signal to the main computing-controlling member 101 to stop the apparatus.

When the winding core member 17 and the cutting core member 18 (which, however, does not rotate itself) start to rotate, the clamping device 20 will act to rotate as well. Based on a value calculated in accordance with the product diameter, pitch, product length and setting time (setting tact), a filling instruction signal from the clamping member 20 will be output to the front portion of the curved metal band plate 10*b* through the instructions from the main computing-controlling member 101.

When the helically wound curved metal band plate 10*c* reaches a predetermined length, the main computing-controlling member 101 will send instruction signal to the cutting controlling member 107 in accordance with the signal from the plasma cutting device 21. At this time, the cutting member 21*a* of the plasma cutting device 21 moves along with the curved metal band plate 10*c* which is helically wound in accordance with the instruction from the main computing-controlling member 101 in parallel to the direction of winding one pitch for one revolution. By this action, the helically wound curved metal band plate 10*c* is cut in the direction perpendicular to axial direction instead of being cut in helical direction. In addition, the cutting member 211*a* receives instruction to perform the actions with respect to the helically wound curved metal band plate 10*c* to be kept at the initial position, to be contacted, to be kept at a predetermined distance, and to be kept at the initial position again. As a result, the cutting is maintained in a well state.

Then, the slag controlling member 108 operates in accordance with the instruction from the main computing-controlling member 101, and inputs instruction signal for absorbing and scraping the slags which have been cut in the slag recovering device 22.

Next, a signal is input into the workpiece conveyance member 109 by the instruction from the main computing-controlling member 101. The workpiece clamping body 23*a* starts to operate in accordance with the instruction, maintains the half-finished interlocked tube 10 that has been cut, and releases the clamping member 20. The clamping member 20 and the winding core member 17 will move backward so as to be withdrawn from the interlocked tube 10. Then, the workpiece clamping body 23*a* will operate to convey the interlocked tube onto the workpiece receiving member 23*b*.

In addition, reference number 111 represents an inputting-displaying member which may include, as expected, an appropriate unit such as an inputting unit or an image displaying unit.

So, in this embodiment, when shaping the tube with a round cross section or a polygonal or oblong cross section in a non-loose, precise and easy way, because the clamping device synchronously rotates with the wound metal band plate, for example, even an interlocked tube is round or oblong, it is able to easily and precisely shape a tube in a rotatable, non-loose, non-twisting and efficient manner. Further, when the automatic formation device (an automatic control unit) obtains a predetermined (desired) average setting tact, i.e., a production time, for each product manufactured, it is calculated according to product diameter (D), pitch (P), product length (L) and setting time (T). Meanwhile, the motor control member performs the three-axis synchronous control to the forming members system spindle motor III, the material conveying system roller motor II and the clamping device system cover motor V with the forming members system spindle motor III as a reference axis in accordance with the pulse instruction from the main computing-controlling member, and a clamping device that is disposed on the tip side of a winding core member rotates in a synchronized manner so as to prevent loosening of the wound metal strip plate, so it is able to control automatically in an easy, precise and efficient way and ensure planned, stable production.

In addition, as the cutting member system pinch roller motor IV is controlled synchronously according to the three-axis synchronous control, it is able to further control automatically in an easy, precise and efficient way and ensure planed, stable production.

In addition, as the motor system has an ability to correct the rotation speed, even if all shafts rotate in the same speed, conveyance may not be steady due to factors such as the material of the metal band plate 10 as a tube, and the sliding of shaping the tube or mechanical consumption, i.e., mechanical losses. So, it is able to adjust the rotation speed to become normal.

In addition, due to the other requirements to easily and efficiently shape the interlocked tube, the oil-applying device is not required to be arranged at a preceding stage of the multistage roll-forming device, instead an upper portion of the multistage roil-forming device has an oil-applying function integrally so as to work efficiently. Meanwhile, the coating agent is also improved, e.g., the lubricating oil mixed with water may be used in order to improve the operation efficiency and reduce the cost. Further, when the interlocked tube cooperating with the main body of the apparatus is cut off, the slags produced belong to granular atomized slags; besides, the slags accumulated during the cutting will be removed efficiently.

Hence, according to the present invention, it is able to obtain the interlocked tube by easily and precisely shaping a tube with a round cross section or a polygonal or oblong cross section in a non-loose manner, so as to provide excellent machining performance when the interlocked tube is cut off, and meanwhile it is able to shape the interlocked tube automatically, so as to provide excellent operation efficiency for the apparatus itself. As long as the above-described actions can be performed, and are not limited to the disclosure of the invention, all kinds of variation, design and modification can be made.

In addition, as for other application of the interlocked tube, it may be applied to a spiral duct of an air conditioner, etc by winding a steel plate into a spiral liner and winding a steel wire into a spiral tube.

REFERENCE SIGN LIST

10—metal band plate for interlocked tube
10*a*—tabular metal band plate
10*b*—curved metal band plate
10*c*—helically wound curved metal band plate
11—main body of the apparatus
12—decoiler
13—pretreatment device
14—multistage roll-forming device
15—oil-applying device
16—direction-variable guiding device
16*a*—variable guiding roller
17—winding core member
18—cutting core member
18*a*—opening of core member
19—winding guiding device
19*a*—winding guiding roller
20—clamping device
20*a*—clamping body
21—plasma cutting device
21*a*—cutting member
22—slag recovering device
22*a*—tube
22*b*—scraping device
22*c*—discharge path
23—workpiece conveyance device
23*a*—workpiece clamping body
23*b*—workpiece receiving member
24—motor
25—control device
26—display device
100—system body
101—main computing-controlling member
102—bending treatment controlling member
103—oil-application controlling member
104—motor controlling member
105—winding treatment controlling member
106—clamping controlling member
107—cutting controlling member
108—slag controlling member
109—workpiece conveyance controlling member
110—decoiling member
111—inputting-displaying member
I—motor system
II—material conveying system roller motor
III—forming members system spindle motor
IV—cutting member system pinch roller motor
V—clamping device system cover motor
VI—cutting unit system unit shifting motor

What is claimed is:

1. A method for manufacturing an interlocked tube, which is of a round, polygonal or oblong cross-section, and shaped by bending an elongate metal band plate into a S-shaped cross section and helically winding the metal band plate onto a winding core member in such a way that two adjacent end portions thereof are engaged with each other by means of members for treating the metal band plate successively in accordance with instructions from a main computing-controlling member, wherein the method comprises the steps of:

using the main computing-controlling member to control actions of each member based on values calculated in accordance with product diameter (D), pitch (P), product length (L) and setting time (T) of the wound metal band plate, and to aggregate the values;

using a motor controlling member to perform treatment in accordance with instructions from the main computing-controlling member, and to perform three-axis synchronous control on a forming members system spindle motor (III), a material conveying system roller motor (II) and a clamping device system cover motor (V) with the forming members system spindle motor (III) as a reference axis via a pulse instruction from the main computing-controlling member; and using a clamping device to synchronously rotate in such a manner that the wound metal band cannot be loosened, and to clamp the metal band plate in a freely loosen or freely tighten manner.

2. The method according to claim 1, wherein the motor controlling controlling member has a cutting member system pinch roller motor (IV) synchronously controlled based on the three-axis synchronous control.

3. The method according to claim 1, wherein the main computing-controlling member adds a desired correction value to a rotation speed of a motor sy stem.

4. The method according to claim 1, wherein the method further comprises the steps of:

using a multistage roll-forming device to shape the tabular metal band plate extracted from a decoiler into a metal band plate with curved side portions; and using an oil-applying device to apply an oily coating agent from an upper portion of the multistage roll-forming device, the oily coating agent being a lubricating oil mixed with water, wherein the multistage roll-forming device and the oil-applying device are pretreatment devices cooperating with the main computing-controlling member.

5. The method according to claim 1, wherein a cutting device cooperating with the main computing-controlling member to receives instruction for absorbing slags and scraping out the accumulated slags.

6. The method according to claim 1, wherein a cutting device cooperating with the main computing-controlling member receives instruction of ejecting the air for cutting.

7. The method according to claim 1, wherein a cutting device cooperating with the main computing-controlling member receives instructions for starting the cutting as in contact with the wound metal band plate, then departing from the wound metal band plate immediately so as to maintain a predetermined distance from the metal band plate, and then stopping the cutting.

8. An apparatus for manufacturing an interlocked tube, which is of a round, polygonal or oblong cross-section, and shaped by bending an elongate metal band plate into a S-shaped cross section and helically winding the metal band plate onto a winding core member in a way that two adjacent end portions thereof are engaged with each other by means of devices for treating the metal band plate successively in accordance with instructions from a controlling device, wherein the apparatus comprises:

the controlling device configured to control actions of each device based on values calculated in accordance with product diameter (D), pitch (P), product length (L) and setting time (T) of the wound metal band plate, and to aggregate the values;

a motor system configured to perform treatment in accordance with instructions from the controlling device, and to perform three-axis synchronous control on a forming members system spindle motor (III), a material conveying system roller motor (II) and a clamping device system cover motor (V) with the forming members system spindle motor (III) as a reference axis via a pulse instruction from a main computing-controlling member; and a clamping device configured to synchronously rotate in such a manner that the wound metal band cannot be loosened, and to clamp the metal band plate in a freely loosen or freely tighten manner.

9. The apparatus according to claim 8, wherein the motor system has a cutting member system pinch roller motor (IV) synchronously controlled based on the three-axis synchronous control.

10. The apparatus according to claim 8, wherein the controlling device adds a desired correction value to a rotation speed of the motor system.

11. The apparatus according to claim 8, wherein a pretreatment device cooperating with the controlling device comprises:

a multistage roll-forming device configured to shape the tabular metal band plate extracted from a decoiler into a metal band plate with curved side portions; and an oil-applying device configured to apply an oily coating agent from an upper portion of the multistage roll-forming device, the oily coating agent being a lubricating oil mixed with water.

12. The apparatus according to claim 8, wherein a cutting device cooperating with the controlling device is configured to receive instruction for absorbing slags and scraping out the accumulated slags.

13. The apparatus according to claim 8, wherein a cutting device cooperating with the controlling device is configured to receive instruction of ejecting the air for cutting.

14. The apparatus according to claim 8, wherein a cutting device cooperating with the controlling device is configured to receive instructions for starting the cutting as in contact with the wound metal band plate, then departing from the wound metal band plate so as to maintain a predetermined distance from the metal band plate, and then stopping the cutting.

* * * * *